US007530391B2

(12) United States Patent
Hall et al.

(10) Patent No.: US 7,530,391 B2
(45) Date of Patent: May 12, 2009

(54) SEAL SECTION FOR ELECTRICAL SUBMERSIBLE PUMP

(75) Inventors: Clarence F. Hall, Claremore, OK (US); Larry J. Parmeter, Broken Arrow, OK (US); Brett D. Leamy, Claremore, OK (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 11/747,363

(22) Filed: May 11, 2007

(65) Prior Publication Data

US 2007/0277969 A1 Dec. 6, 2007

Related U.S. Application Data

(60) Provisional application No. 60/810,115, filed on May 31, 2006.

(51) Int. Cl.
*E21B 43/00* (2006.01)

(52) U.S. Cl. ..... 166/105; 166/68; 417/414

(58) Field of Classification Search ..... 166/105, 166/68, 66.4; 417/414; 415/230, 901
See application file for complete search history.

(56) References Cited

U.S. PATENT DOCUMENTS 3,384,769 A * 5/1968 Schaefer et al. ..... 310/87
3,404,924 A * 10/1968 Choate ..... 384/149
3,965,381 A 6/1976 Shipman
4,436,488 A 3/1984 Witten
4,539,498 A 9/1985 Wilkes
4,586,880 A 5/1986 Inao et al.
4,966,532 A * 10/1990 Fengsheng ..... 417/366
4,992,689 A * 2/1991 Bookout ..... 310/87
5,622,222 A * 4/1997 Wilson et al. ..... 166/105.4
6,268,672 B1 * 7/2001 Straub et al. ..... 310/87
6,602,059 B1 8/2003 Howell et al.
6,666,664 B2 12/2003 Gross
6,863,124 B2 3/2005 Araux et al.
2007/0140876 A1 * 6/2007 Parmeter et al. ..... 417/423.11

* cited by examiner

*Primary Examiner*—David J. Bagnell
*Assistant Examiner*—Cathleen R Hutchins
(74) *Attorney, Agent, or Firm*—Bracewell & Giuliani LLP

(57) ABSTRACT

A seal section for a submersible well pump assembly has a housing for connection between a pump and a motor. A central radial bearing support rotatably supports a drive shaft and defines upper and lower chambers in the housing. A well fluid passageway leads from an exterior portion of the housing to the upper chamber. Upper and lower isolation tubes extend around the shaft within the upper and lower chambers, defining an annular passage for fluid communication with lubricant contained in the motor. A bladder surrounds the upper isolation tube for separating lubricant from well fluid in the upper chamber. A labyrinth tube within the bladder has an upper end in fluid communication with a labyrinth port leading through the upper isolation tube and a lower end in fluid communication with the lower chamber.

16 Claims, 2 Drawing Sheets

SEAL SECTION FOR ELECTRICAL SUBMERSIBLE PUMP

CROSS-REFERENCE TO RELATED APPLICATION

This application claims priority to provisional patent application Ser. No. 60/810,115, filed May 31, 2006.

FIELD OF THE INVENTION

This invention relates in general to electrical submersible well pumps and in particular to a seal section that locates between the pump motor and the pump for equalizing lubricant pressure contained within the motor with hydrostatic pressure on the exterior.

BACKGROUND OF THE INVENTION

Electrical submersible pumps are often used for pumping a mixture of oil and water from a well. Normally the pump assembly has an electrical motor and a rotary pump, which may be centrifugal or other types. The motor is filled with a dielectric lubricant, and a seal section between the motor and the pump serves to equalize the internal pressure of the lubricant with the hydrostatic pressure on the exterior of the pump assembly.

A typical seal section, also called a pressure equalizer, has a tubular housing through which a drive shaft extends for transmitting rotation of the motor to the pump. A thrust bearing assembly is often located in the seal section for absorbing downthrust created by the pump. The lubricant in the pump also lubricates the thrust bearing.

Various means are employed to equalize lubricant pressure with the well fluid. A tubular elastomeric bladder may be mounted in the seal section, the bladder having an interior in fluid communication with the lubricant in the motor. A well fluid passageway allows well fluid to enter the seal section on the exterior of the bladder. Labyrinth tubes are also employed, either alone or in a separate chamber from the bladder. The water of the well fluid is normally denser than the oil. Generally, the labyrinth tubes are mounted with an upper inlet and a lower outlet, so that water flowing downward through the tube cannot flow back upward through the outlet in a manner so as to migrate into the motor.

The seal section also has features to accommodate expansion of the lubricant in the motor, which occurs as the motor gets hotter. A check valve may be employed to expel excess lubricant without allowing the entry of well fluid.

Most seal sections have multiple chambers, usually two to four, for housing the bladder and labyrinth tubes. Normally, each chamber is a cylindrical sleeve secured at its upper and lower ends by threads to adapters and shaft support members. The additional threaded sleeves add to the cost of a seal section.

SUMMARY

The seal section of this invention has a number of desirable features. A labyrinth tube is located within the bladder for expelling air during filling. The labyrinth tube has a lower end that connects to a separate oil-filled chamber.

The seal section has upper and lower adapters for securing the seal section between a pump and motor. The housing is a single cylindrical sleeve connected between the upper and lower adapters. A thrust bearing assembly is located in the housing above the lower adapter. Lower and central radial bearing supports fit within the housing for radially supporting the shaft. Isolation tubes enclose the shaft and connect between the lower and central radial bearing supports and the central radial bearing support and the upper adapter. The lower and central radial bearing supports, the isolation tubes, and the bag can be assembled as a unit and inserted into one end of the housing.

DETAILED DESCRIPTION OF THE INVENTION

Figure 3:
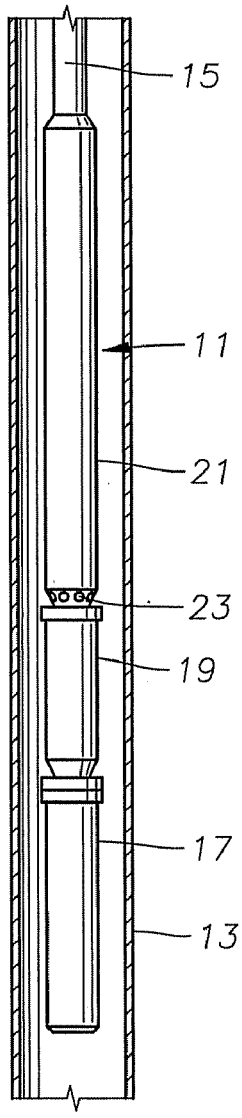
FIG. 3 is a schematic sectional view of an electrical submersible pump assembly in accordance with this invention.

Referring to FIG. 3, an electrical submersible pump assembly 11 ("ESP") is shown installed within casing 13 in a well. ESP 11I is suspended on a string of tubing 15, and in this embodiment, discharges well fluid up tubing 15. ESP 11 has a motor 17, typically a three-phase AC motor. Motor 17 is connected to a seal section 19, which in turn is connected to a pump 21. Motor 17 is filled with a lubricant, and seal section 19 equalizes the lubricant pressure with the hydrostatic pressure of the well fluid on the exterior. Pump 21 is a rotary pump, such as a centrifugal pump having a large number of stages, each stage having an impeller and a diffuser. Pump 21 has an intake 23 on its lower end that draws well fluid in.

Figure 1A:
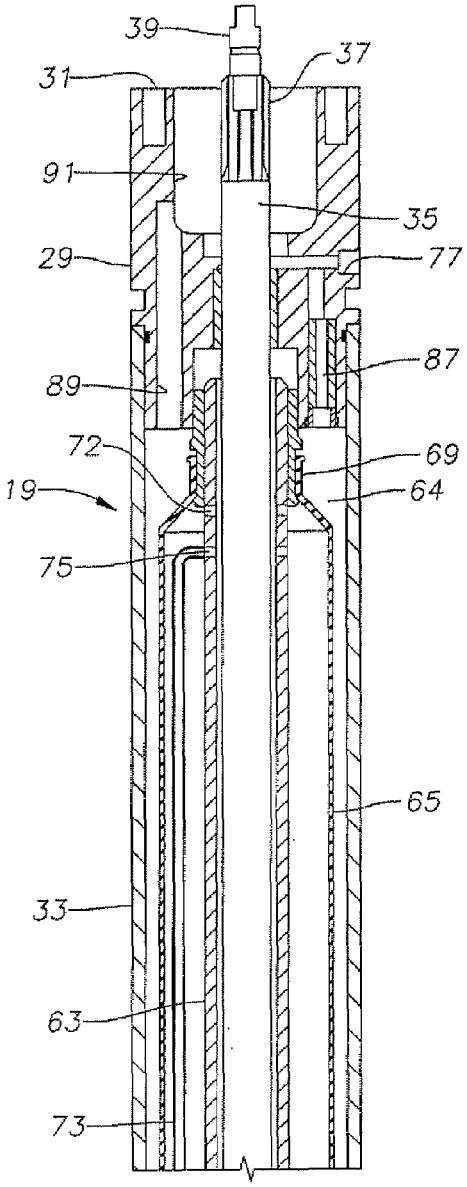
FIGS. 1A and 1B comprise a vertical sectional view of a seal section for an electrical submersible well pump assembly in accordance with this invention.
Figure 1B:
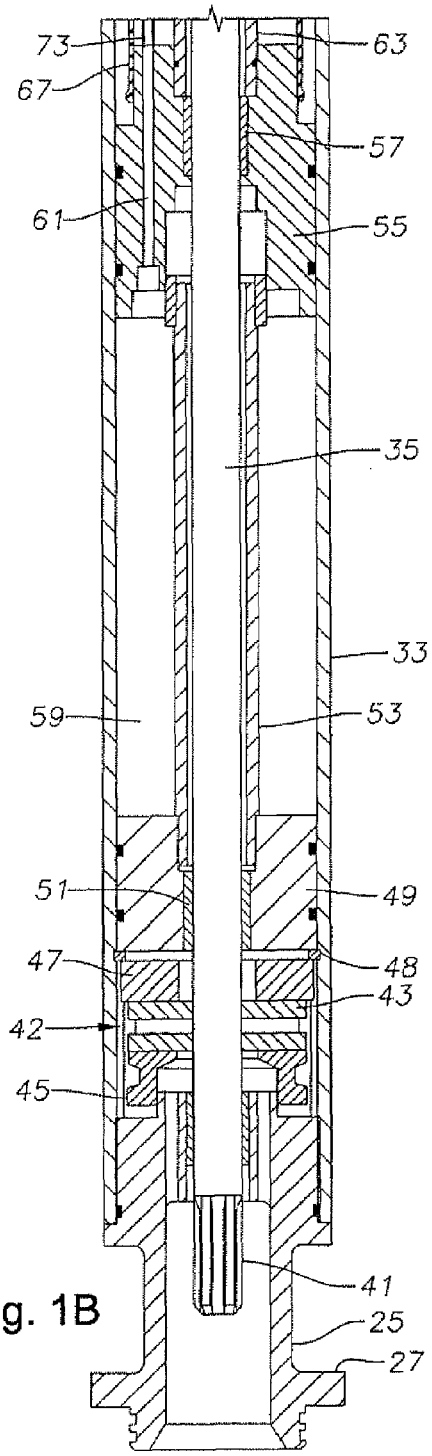

Referring to FIGS. 1A and 1B, seal section 19 has a lower adapter 25 for securing to motor 17 (FIG. 3). Lower adapter 25 typically has a flange 27 that receives bolts that bolt to a mating flange of motor 17. An upper adapter 29 (FIG. 1A) connects seal section 19 to pump 21 (FIG. 3). Upper adapter 29 has threaded holes 31 for receiving bolts from a lower adapter of pump 21. Seal section 19 has a housing 33 that comprises a cylindrical sleeve secured to lower and upper adapters 25, 29, preferably by threads. Housing 33 is preferably a single integral member.

A shaft 35 extends through seal section 19 for transmitting rotary motion from motor 17 (FIG. 3) to pump 21. Shaft 35 has an upper splined end 37 that optionally may have a latch member 39. Latch member 39 latches to the shaft (not shown) of pump 21 (FIG. 3) so as to transmit tension. Shaft 35 has lower splined end 41 that engages the shaft of motor 17 (not shown).

A conventional thrust bearing 42 is located in seal section 19, as illustrated in FIG. 11B. Thrust bearing 42 comprises a rotary thrust member or runner 43 that is secured to shaft 35. Runner 43 rotatably engages a stationary downthrust member or base 45 that is mounted to the upper side of lower adapter 25. Runner 43 also engages a stationary upthrust member 47 while in upthrust. Upthrust member 47 is supported within housing 33 against upward movement by a retainer ring 48, which may be a snap ring.

A lower radial bearing support 49 is supported in housing 33 against downward movement by retainer ring 48. Lower radial bearing support 49 has a bushing 51 that is slidably engaged by shaft 35. Bushing 51 does not form a seal on shaft 35 and may have passages or channels through it to freely allow the passage of motor lubricant. Lower radial bearing support 49 has seals on its exterior that sealingly engage the inner diameter of housing 33. A lower isolation tube 53 extends sealingly into a counterbore in lower radial bearing support 49 at the upper end of bushing 51. Lower isolation tube 53 has an inner diameter that is larger than the outer diameter of shaft 35, creating an annular passage for the flow of motor lubricant. Motor lubricant is free to flow between the area surrounding thrust bearing 42 and the annular clearance within lower isolation tube 53.

The upper end of lower isolation tube 53 extends into sealing engagement with a counterbore in a central radial bearing support 55. Central radial bearing support 55 has seals on its exterior that seal against the inner diameter of housing 33. Central radial bearing support also has a bushing 57 that slidingly engages shaft 35 but does not seal against the flow of lubricant. A lower chamber 59 is defined by the annular space between radial bearing supports 49 and 55 and surrounding lower isolation tube 53. A passage 61 extends through central radial bearing support 55 from its lower end to its upper end.

Figure 2:
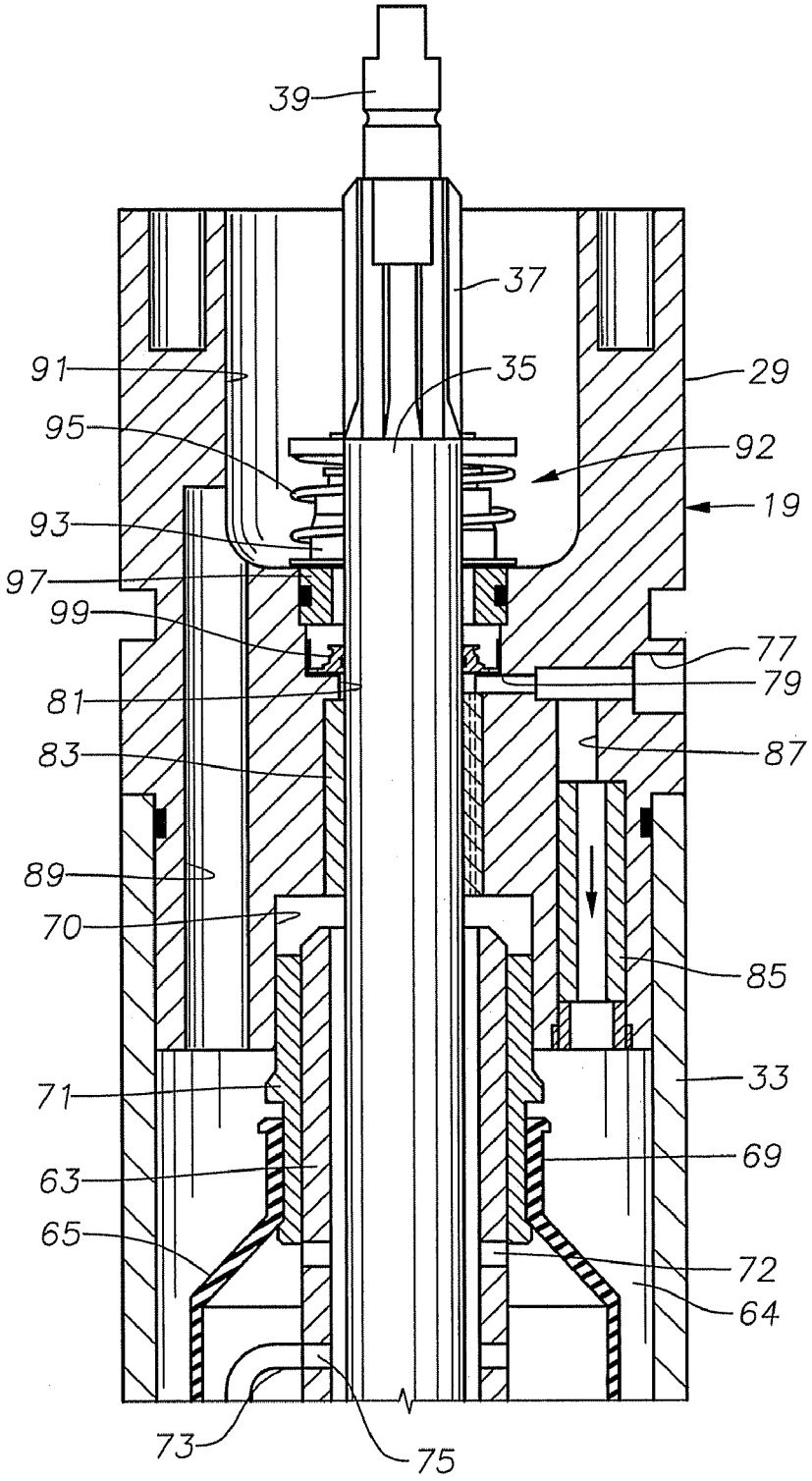
FIG. 2 is an enlarged sectional view of an upper portion of the seal section of FIG. 1.

Referring to FIGS. 1A and 1B, an upper isolation tube 63 has its lower end sealingly engaged in a counterbore in central radial bearing support 55 above bushing 57. The upper end of upper isolation tube 63 extends to upper adapter 29, defining an annular upper chamber 64 within housing 33. A tubular elastomeric bladder 65 is located within upper chamber 64. Bladder 65 has a lower end 67 that fits sealingly around an upper neck portion of central radial bearing support 55. Bladder 65 has a neck 69 on its upper end that is sealingly secured to a bladder retainer 71, as shown in FIG. 2. Bladder retainer 71 is a tubular member that is secured by threads to the upper end of upper isolation tube 63. Bladder retainer 71 has an upper portion that sealingly engages a counterbore 70 formed in the lower end of upper adapter 29.

Referring again to FIGS. 1A and 1B, a port 72 is located in the sidewall of upper isolation tube 63 near its upper end. Port 72 communicates the annular clearance within upper isolation tube 63 with the interior of bladder 65. In addition, a labyrinth tube 73 has its upper end secured to a port 75 located adjacent port 72. Port 75 is shown below port 72, but it could be located at the same level or even above port 72. Labyrinth tube 73 is a small diameter tube that extends from port 75 downward alongside upper isolation tube 63 sealingly into the upper end of passage 61 (FIG. 1B) in central radial bearing support 55. Lubricant within lower chamber 59 thus communicates with lubricant in the annular clearance around shaft 35 within isolation tubes 53 and 63 via labyrinth tube 73.

Referring to FIG. 2, a threaded plug receptacle 77 is located in upper adapter 29. Plug receptacle 77 will normally contain a plug (not shown) during operation, but it is removed during the lubricant filling procedure. A radially extending passage 79 joins an inner end of plug receptacle 77 and extends inward to an axial passage 81 through which shaft 35 extends. A bushing 83 is located within passage 81 for slidingly engaging and radially supporting shaft 35. Bushing 83 does not provide a seal against the flow of lubricant and may have flow passages through it as indicated by the dotted lines in FIG. 2. One or more check valves 85 are located within a vent port 87 in upper adapter 29. Vent port 87 extends upward from the lower end of upper adapter 29 into an intersection with radial passage 79 inward from plug receptacle 77. Check valve 85 will allow downward flow of fluid into upper chamber 64 but not allow upward flow. A well fluid port 89 extends from the lower end of upper adapter 29 to a cavity 91 formed in the upper end of upper adapter 29. Cavity 91 is in fluid communication with well fluid on the exterior of seal section 19 via intake 23 (FIG. 3) of pump 21. Well fluid port 89 alternately could extend through an exterior side wall of upper adapter 29.

A mechanical seal assembly 92 is located at the upper end of shaft 35 for sealing against the encroachment of well fluid from cavity 91 into motor 17 (FIG. 3) In this embodiment, mechanical seal assembly 92 includes a rotary seal member 93 that rotates with shaft 35 and is biased by a coiled spring 95 against a stationary seal base 97. A secondary shaft seal 99 may optionally be located below seal base 97. Lubricant seal 99 is shown to be a conventional shaft oil seal. Preferably a lubricant is located between oil seal 99 and seal assembly 92, and that lubricant may differ from the motor lubricant.

To assemble seal section 19, the internal components of sleeve or housing 33 are pre-assembled and pushed into housing 33 from one end. For example, the user may first install lower adapter 25, thrust bearing 42 and shaft 35 in housing 33. The user then would preassemble upper and lower isolation tubes 63, 53 with radial bearing support members 49 and 55 and bladder 65. The user then would push this subassembly over shaft 35 and into housing 33. The user then would secure upper adapter 29 to housing 33. Counterbore 70 slides sealingly over bladder retainer 71 to make up the engagement while the threads on upper adapter 29 engage the threads within housing 33.

Prior to operation, motor 17 and seal section 19 are filled with a motor lubricant, and various methods can be employed. In one technique, motor 17 is initially filled with lubricant at a manufacturing or service facility. At the well site, seal section 19 is secured to the upper end of motor 17, and the lubricant is pumped in from a fill port (not shown) at the upper end of motor 17. The plug for receptacle 77 (FIG. 2) is removed prior to pumping the lubricant into motor 17 (FIG. 3). The operator can pump lubricant from the fill port upward in seal section 19 until lubricant begins to flow out plug receptacle 77, Air in seal section 19 would be displaced out port 77 during that procedure.

During filling, lubricant flows upward through the spaces around thrust bearing 42 (FIG. 1B) and the annular clearance around shaft 35 in lower isolation tube 53. The lubricant flows up through the annular clearance in upper isolation tube 63 and down into bladder 65 via port 72 (FIG. 1A). Lubricant also flows into lower chamber 59 via labyrinth tube 73 and passage 61. Once lower chamber 59 and the interior of bladder 65 are filled, the lubricant will flow up into the spaces around shaft 35 in upper adapter 29, at least up to oil seal 99, if utilized.

After filling, a plug is installed in receptacle 77 and ESP 11 (FIG. 3) is lowered into the well. As ESP 11 is lowered into the well, well fluid enters upper chamber 64 via cavity 91 and passage 89. The hydrostatic pressure of the well fluid is exerted via bladder 65 to the lubricant within bladder 65 and motor 17. When at the desired depth, the operator supplies power to motor 17, causing pump 21 to draw well fluid in through intake 23 and discharge the well fluid through tubing 15 to the surface.

Motor 17 will begin to heat up, which causes the lubricant to expand. Due to the expansion, excess lubricant may vent through ports 79, 87 and check valves 85 into upper chamber 64. The lubricant is normally less dense than the well fluid, which often contains a high percentage of salt water, thus the vented lubricant in upper chamber 64 will typically gravitate upward through passage 89 and into cavity 91 where it would be pumped to the surface by pump 21 (FIG. 3).

Over time, some leakage of well fluid past mechanical seal 92 and oil seal 99 may occur. If so, this well fluid will gravitate downward past bushing 83 and into the annular clearance surrounding upper isolation tube 63. Some of the well fluid will flow out port 72 into bladder 65. Some of the well fluid will flow down labyrinth tube 73 into lower chamber 59. Any well fluid that enters bladder 65 will collect at the lower end and would not be able to reenter port 72 located near the upper end of bladder 65. Also, any well fluid that may collect in lower chamber 59 would not be able to flow upward into ports 72 or 75.

The invention has significant advantages. The single cylindrical sleeve of the housing reduces cost over multiple sleeve housings. Because the lower and central radial bearing supports slide into the housing, the seal section can have more volume for oil expansion than a prior art seal section having the same overall length. The labyrinth tube allows bleeding of trapped air and provides an additional barrier for well fluid in the event of leakage. The oil seal serves as backup seal to reduce entry of well fluid into contact with the lubricant. Filling and servicing are more easily performed.

While the invention has been shown in only one of its forms, it should be apparent to those skilled in the art that it is not so limited but is susceptible to various changes without departing from the scope of the invention.

The invention claimed is:

1. A seal section for a submersible well pump assembly, comprising:

a housing for connection between a pump and a motor of a submersible well pump assembly;

a rotatable shaft extending through housing for transmitting rotational motion from the motor to the pump;

a central radial bearing support that rotatably supports the shaft and which defines upper and lower chambers in the housing;

a well fluid passageway leading from an exterior portion of the housing to the upper chamber;

upper and lower isolation tubes extending around the shaft within the upper and lower chambers, respectively, each of the isolation tubes having an inner diameter larger than the shaft, defining an annular passage for fluid communication with lubricant contained in the motor;

a bladder surrounding the upper isolation tube in the upper chamber for separating lubricant within the bladder from well fluid in the upper chamber on the exterior of the bladder; and a labyrinth tube within the bladder and having an upper end in fluid communication with a labyrinth port leading through the upper isolation tube near its upper end to the annular passage, the labyrinth tube having a lower end in fluid communication with the lower chamber.

2. The seal section according to claim 1, further comprising:

upper and lower adapters for connection to the pump and to the motor, respectively;

a thrust bearing assembly mounted in the housing below the lower chamber above the lower adapter; and the housing comprises a single cylindrical sleeve extending from the lower adapter to the upper adapter.

3. The seal section according to claim 1, further comprising:

a bladder communication port in a sidewall of the upper isolation tube within the bladder for communicating lubricant in the annular passage with the interior of the bladder.

4. The seal section according to claim 1, further comprising:

an upper adapter secured to an upper end of the housing for connection to the pump, the upper adapter having a shaft passage through which the shaft extends;

a seal base stationarily mounted in the shaft passage of the upper adapter;

a spring-biased rotary seal member connected to the shaft and in rotational, sliding engagement with the seal base; and an oil seal mounted between the shaft and the upper adapter below the seal base for preventing any well fluid that leaks past the seal base from flowing downward into the annular passage in the upper isolation tube.

5. The seal section according to claim 1, further comprising:

an upper adapter secured to an upper end of the housing for connection to the pump, the upper adapter having a shaft passage through which the shaft extends;

a bladder retainer between an upper end of the bladder and the upper isolation tube for sealingly securing the upper end of the bladder to an upper end of the upper isolation tube; and wherein the bladder retainer stabs sealingly into a lower end of the shaft passage in the upper adapter.

6. A seal section for a submersible well pump assembly, comprising:

upper and lower adapters for connection to a pump and to a motor, respectively of a submersible well pump assembly;

a single continuous sleeve extending from the lower to the upper adapter;

a rotatable shaft extending through the upper and lower adapters and the sleeve for transmitting rotational motion from the motor to the pump;

a thrust bearing assembly mounted in the sleeve above the lower adapter for adsorbing downthrust on the shaft;

a lower radial bearing support that rotatably supports the shaft above the thrust bearing, the lower radial bearing support having a seal that seals to an inner diameter of the sleeve, the lower radial bearing support having a maximum outer diameter less than the inner diameter of the sleeve so that the entire lower radial bearing support fits within the sleeve;

a central radial bearing support that rotatably supports the shaft above the lower radial bearing support, the central radial bearing support having a seal that seals to the inner diameter of the sleeve, defining upper and lower chambers in the sleeve, the central radial bearing support having a maximum outer diameter less than the inner diameter of the sleeve so that the entire central radial bearing support fits within the sleeve;

a well fluid passageway leading from an exterior portion of the sleeve to the upper chamber; and upper and lower isolation tubes extending around the shaft within the upper and lower chambers, respectively, each of the isolation tubes having an inner diameter larger than the shaft, defining an annular passage for fluid communication with lubricant contained in the motor, the upper isolation tube being connected between the central radial bearing support and the upper adapter, the lower isolation tube being connected between the central radial bearing support and the lower radial bearing support.

7. The seal section according to claim 6, further comprising:

a bladder located within the upper chamber, the bladder having an upper end connected to the upper adapter and a lower end connected to the central radial bearing support; and a labyrinth tube having an upper end connected to a port in the upper isolation tube within the bladder and a lower end communicating with the lower chamber through a communication passage in the central radial bearing support.

8. The seal section according to claim 6, further comprising:

a seal base stationarily mounted in a shaft passage of the upper adapter;

a spring-biased rotary seal member connected to the shaft and in rotational, sliding engagement with the seal base; and an oil seal mounted between the shaft and the upper adapter within the shaft passage and below the seal base for preventing any well fluid that leaks past the seal base from flowing downward into the annular passage in the upper isolation tube.

9. The seal section according to claim 6, wherein the lower radial bearing support, central radial bearing support and upper and lower isolation tubes are insertable as a unit into the sleeve.

10. A seal section for a submersible well pump assembly, comprising:

a housing for connection between a pump and a motor of a submersible well pump assembly;

a rotatable shaft extending through housing for transmitting rotational motion from the motor to the pump;

a central radial bearing support within the housing that rotatably supports the shaft and which defines upper and lower chambers in the housing;

upper and lower isolation tubes extending around the shaft within the upper and lower chambers, respectively, each of the isolation tubes having an inner diameter larger than the shaft, defining an annular passage for fluid communication with lubricant contained in the motor;

a bladder surrounding the upper isolation tube in the upper chamber;

a bladder communication port in a sidewall of the upper isolation tube within the bladder for communicating lubricant in the annular passage with the interior of the bladder; and a labyrinth tube within the bladder and having an upper end in fluid communication with a labyrinth port in the sidewall of the upper isolation tube, the labyrinth tube having a lower end in fluid communication with the lower chamber.

11. The seal section according to claim 10, wherein the housing comprises a single sleeve.

12. The seal section according to claim 10, wherein the central radial bearing support is located entirely within the housing and has a seal on its outer diameter that sealingly engages an inner diameter of the housing.

13. The seal section according to claim 10, wherein the central radial bearing support has a labyrinth tube passage extending between the upper and lower chambers, and the lower end of the labyrinth tube extends sealingly into an upper end of the labyrinth tube passage.

14. The seal section according to claim 10, further comprising:

a lower radial bearing support within the housing, the lower radial bearing support and the central radial bearing support each having a shaft passage through which the shaft extends;

the lower isolation tube having lower and upper ends that sealingly engage the shaft passages in the lower radial bearing support and the central radial bearing support; and wherein the lower and central radial bearing supports, the lower and upper isolation tubes, and the bladder define a subassembly that is insertable as a unit into the housing.

15. The seal section according to claim 10, further comprising:

an upper adapter that secures to an upper end of the housing for connecting the housing to the pump, the upper adapter having a shaft passage through which the shaft extends;

a bladder retainer sealingly securing an upper end of the bladder to an upper end of the upper isolation tube; and wherein the bladder retainer stabs sealingly into a lower end of the shaft passage in the upper adapter.

16. The seal section according to claim 10, further comprising:

an upper adapter that secures to an upper end of the housing for connecting the housing to the pump, the upper adapter having a shaft passage through which the shaft extends;

a seal base stationarily mounted in the shaft passage of the upper adapter;

a spring-biased rotary seal member connected to the shaft and in rotational, sliding engagement with the seal base; and an oil seal mounted between the shaft and the upper adapter within the shaft passage and below the seal base for preventing any well fluid that leaks past the seal base from flowing downward into the annular passage in the upper isolation tube.

* * * * *